US005395169A

United States Patent [19]

Röck et al.

[11] Patent Number: 5,395,169

[45] Date of Patent: Mar. 7, 1995

[54] PULL-OUT GUIDE FOR DRAWERS

[75] Inventors: Erich Röck, Höchst, Austria; Fredi Dubach, Adetswil, Switzerland

[73] Assignee: Julius Blum Gesellschaft m.b.H., Höchst, Austria

[21] Appl. No.: 201,127

[22] Filed: Feb. 24, 1994

[30] Foreign Application Priority Data

Mar. 4, 1993 [AT] Austria ..... 412/93

[51] Int. Cl.[6] ..... A47B 88/04

[52] U.S. Cl. ..... 384/19

[58] Field of Search ..... 384/19, 21, 18, 23, 384/20; 312/333

[56] References Cited

U.S. PATENT DOCUMENTS

| | | | |
|---|---|---|---|
| 1,676,991 | 7/1928 | Bergmann | 384/19 |
| 2,574,162 | 11/1951 | Baker | 384/19 |
| 2,747,943 | 5/1956 | Metcalf | 384/19 |
| 2,985,491 | 5/1961 | Hayes | 384/19 |
| 3,026,149 | 3/1962 | Ruhnke | 384/19 |
| 3,477,770 | 11/1969 | Niemi . | |
| 3,876,263 | 4/1975 | Oleksiak | 384/21 |
| 4,176,890 | 12/1979 | Gorton . | |
| 4,436,357 | 3/1984 | Röck et al. | 384/19 X |
| 4,659,237 | 4/1987 | Rapp | 384/19 |

FOREIGN PATENT DOCUMENTS

| | | | |
|---|---|---|---|
| 2701712 | 7/1978 | Germany . | |
| 3627408 | 10/1987 | Germany . | |
| 903221 | 8/1962 | United Kingdom | 384/19 |

*Primary Examiner*—Thomas R. Hannon

*Attorney, Agent, or Firm*—Wenderoth, Lind & Ponack

[57] ABSTRACT

A pull-out guide for a drawer includes a support rail to be mounted on a side of a furniture body or carcass and a pull-out rail to be mounted on the side of the drawer. Guide members such as rollers transmit the load of the drawer and are mounted on the rails. The rollers of the support rail and of the pull-out rail are offset perpendicular to the direction of pulling out the pull-out rail relative to the support rail. The pull-out rail thus is guided on two tracks. The pull-out rail has at least one horizontal tab which projects below a running web of the support rail and forms a lift protection preventing the pull-out rail from being lifted off the support rail.

7 Claims, 5 Drawing Sheets

11
11
5
12
15

11
5
12
15

9
15
5

PULL-OUT GUIDE FOR DRAWERS

BACKGROUND OF THE INVENTION

The invention relates to a pull-out guide fitting for drawers and including a support rail to be mounted on a side of a furniture body or carcass side and a pull-out rail to be mounted on a respective side of the drawer. Guide members such as rollers or slide means transmit the drawer load and are mounted on the rails. The rails having running webs running on the rollers or slide means. The rollers or slide means of the support rail and of the pull-out rail are offset perpendicular to the direction of pulling out of the drawer and the pull-out rail. Therefore, the pull-out rail is guided on two tracks.

SUMMARY OF THE INVENTION

It is the object of the invention to provide an improved pull-out guide fitting of the above-mentioned type such that it has a lift protection means which prevents the drawer from being lifted undesirably away from the support rail on the carcass side, while however removal of the drawer from the furniture carcass is not prevented, even in cases when there is little free space available between drawers of a furniture carcass which are arranged one above the above.

The object of the invention is achieved in that each pull-out rail has at least one horizontal tab which projects below the running web of the support rail and forms the lift protection means for the drawer. A particularly stable construction is provided if each pull-out rail has three horizontal tabs.

BRIEF DESCRIPTION OF THE DRAWINGS

An embodiment of the invention will be described in detail below, with reference to the attached drawings, wherein.

DETAILED DESCRIPTION OF THE INVENTION

Figure 1:
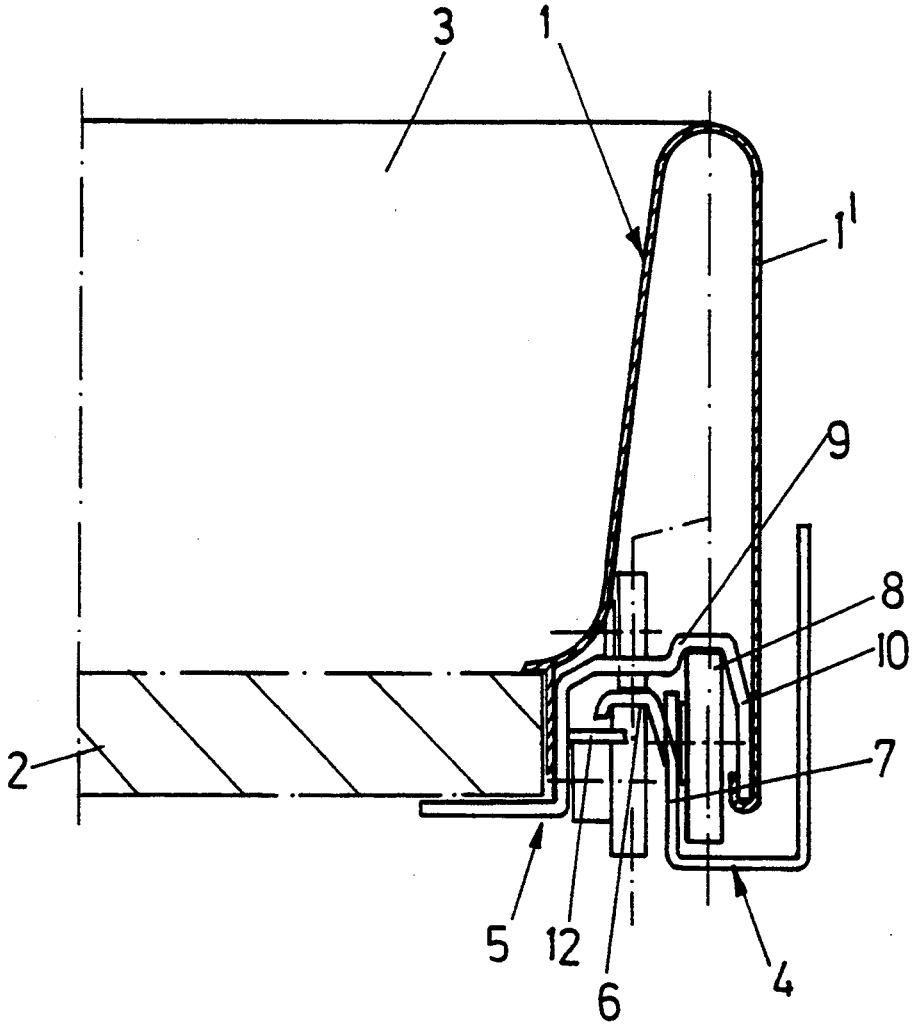
FIG. 1 is a transverse section of a frame of a drawer at one side thereof and of a respective pull-out guide fitting.

Of the drawer, only a drawer side frame 1, a drawer base 2 and a drawer rear wall 3 are shown. For the sake of better clarity, the front panel of the drawer is not illustrated.

On each side of the drawer, a pull-out guide thereof is covered by the drawer frame 1 and includes a support rail 4, which is secured to a carcass side wall, and a pull-out rail 5, which is secured to the drawer side wall or to the drawer base 2.

The support rail 4 has a horizontal running web 6 directed towards the drawer and constructed at the upper edge of a vertical web 7. The vertical web 7 carries, at the front end of the support rail 4, a roller 8 which is secured to the side of the vertical web 7 opposite the running web 6. This means that the roller 8 is located between the vertical web 7 and the carcass side wall or an outer wall 1' of the double-walled drawer frame 1.

The pull-out rail 5 extends over the running web 6 and the vertical web 7 and the roller 8 of the support rail 4. Rail 5 has a running web 9 that thus extends outwardly of the running web 6 of the support rail 4. Furthermore, the pull-out rail 5 has an outer free marginal web 10 which is suspended by an outer wall 1' of the drawer frame 1. Each pull-out rail 5 is provided at the rear end thereof with two rollers 11 which are arranged one above the other and which run along and against the running web 6 of the support rail 4, respectively from above and from below.

Figure 2:
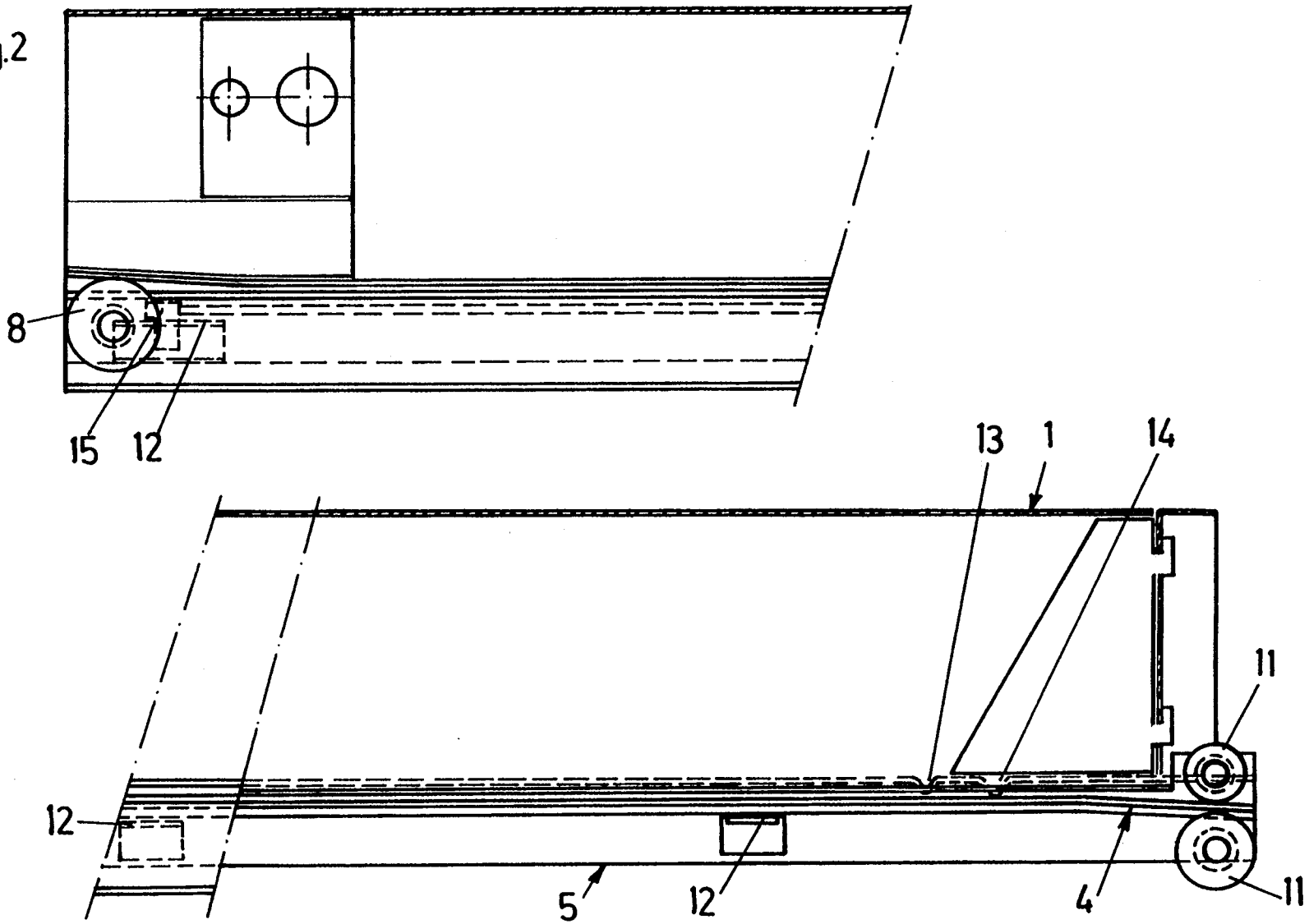
FIG. 2 is a side view, partially in section, of the drawer and of the pull-out guide fitting, with the drawer closed.
Figure 3:
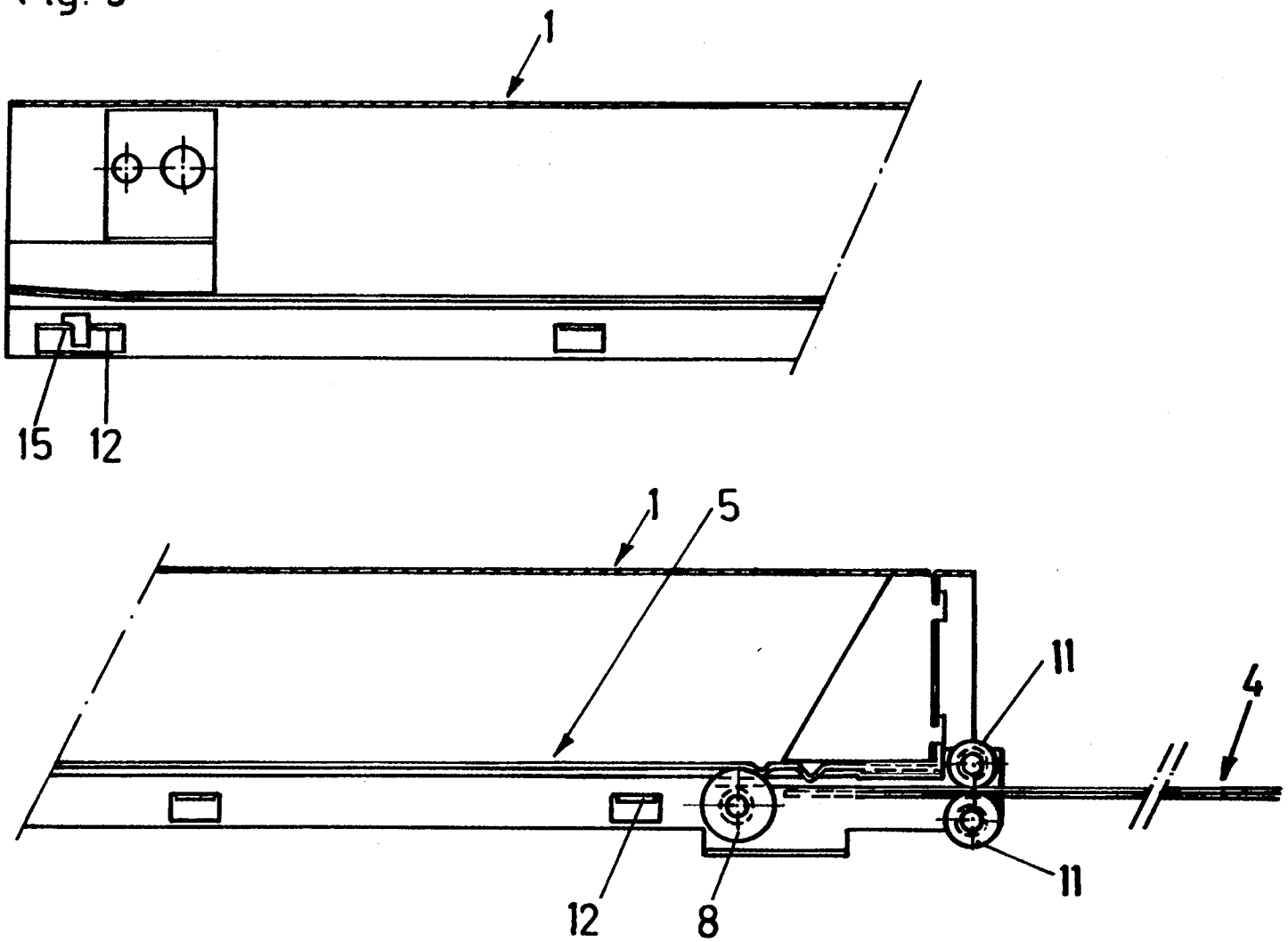
FIG. 3 is a similar view, but with the drawer pulled out.
Figure 4:
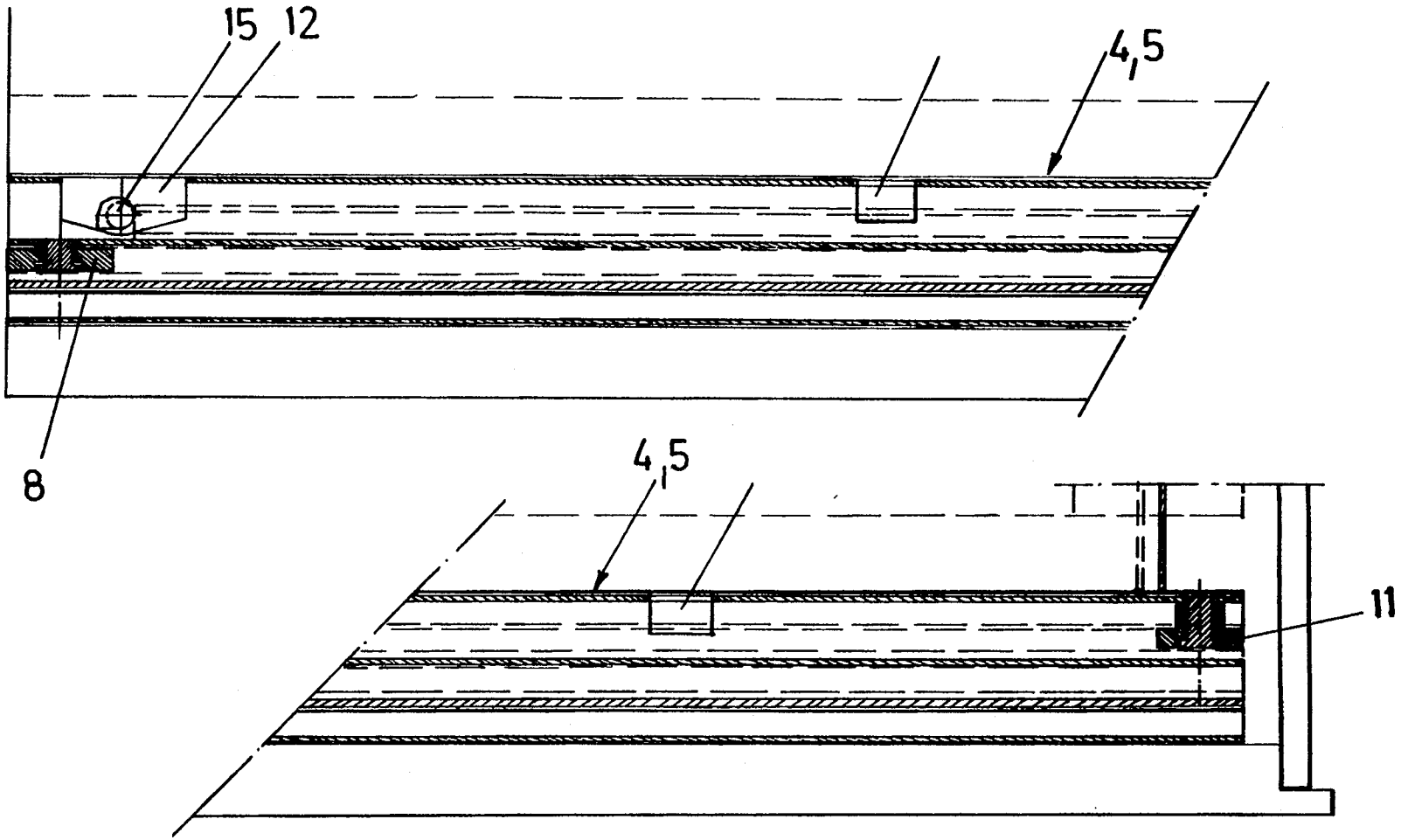
FIG. 4 is a horizontal section through the frame and the pull-out guide fitting on one side of the drawer, with the drawer closed.

As can be seen from FIGS. 1 to 3, each pull-out rail 5 is provided with three horizontal tabs 12 which, from the side, project below the running web 6 of the support rail 4. These tabs 12 form a lift protection means which prevents the pull-out rail 5, and thus the entire drawer, from being undesirably lifted away from the support rail 4.

Because the tabs 12 and rollers 11 are located at an inner track or portion of the pull-out guide fitting, when the drawer is taken completely out of the carcass they do not have to be raised over the rollers 8 of the support rail 4. The pull-out rails 5 can thus be pulled straight out of the furniture carcass. To take the drawer right out of the carcass, the drawer only needs to be raised far enough for stops 13, 14 at the rear of each pull-out rail 5 to be guided over the roller 8 of the respective support rail 4.

Figures 5, 6, 7:
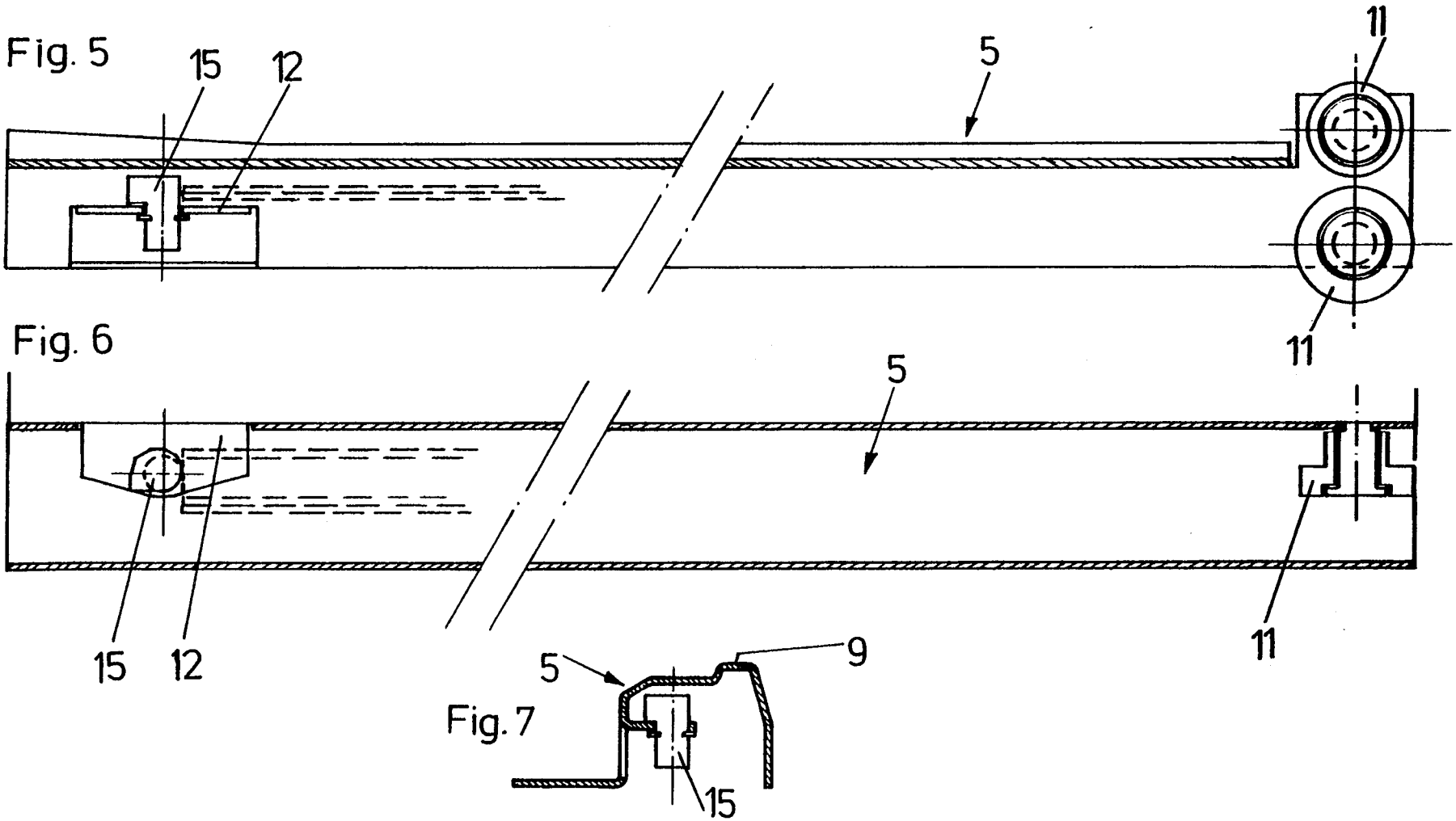
FIG. 5 is a side view of a pull-out rail, partially in section.
FIG. 6 is a horizontal section through the pull-out rail.
FIG. 7 is a transverse section through the pull-out rail.

In the frontmost tab 12 of each of each pull-out rail 5 is mounted an eccentric 15 which is rotatable about a vertical axis. As can be seen in particular from FIGS. 5 and 6, when the drawer is pushed in, the eccentric 15 abuts against the front of the respective support rail 4. By adjusting the eccentric 15, the effect is that, on pushing in the drawer, the front panel of the drawer does not strike against the furniture carcass. The spacing between the front panel and the furniture carcass or the side walls thereof is adjusted by turning the eccentrics 15. Because the energy of moving the drawer is taken up between the rails 4, 5, the mountings of the front panel onto the drawer frames 1 are prevented from working loose.

We claim:

1. A pull-out guide fitting to be mounted on a side of a drawer to guide sliding movement of the drawer into and out of a furniture body, said fitting comprising:

a longitudinal support rail to be mounted on a side of the furniture body;

a longitudinal pull-out rail to be mounted on a side of the drawer;

said support rail and said pull-out rail having respective longitudinal running webs;

said support rail having mounting thereon at least one guide member running on said running web of said pull-out rail during relative longitudinal movement between said rails;

said pull-out rail having mounted thereon at least one guide member running on said running web of said support rail during said relative longitudinal movement;

said at least one guide member of said pull-out rail and said at least one guide member of said support rail being offset in a direction transverse to a direction of said relative longitudinal movement, such that movement of said pull-out rail is guided along two tracks spaced in said transverse direction; and said pull-out rail having extending therefrom at least one horizontal tab projecting below said running web of said support rail, thereby preventing said pull-out rail from being lifted off said support rail.

2. A fitting as claimed in claim 1, wherein said pull-out rail has plural, longitudinally spaced horizontal tabs.

3. A fitting as claimed in claim 2, wherein said pull-out rail has three said tabs.

4. A fitting as claimed in claim 2, further comprising an eccentric mounted for rotation about a vertical axis on a frontmost said tab at a position to abut a front end of said support rail at a pushed in position of said pull-out rail relative to said support rail.

5. A fitting as claimed in claim 1, wherein said guide members comprise rollers.

6. A fitting as claimed in claim 1, wherein said guide member of said support rail comprises a roller mounted on a side of said support rail opposite said running web thereof.

7. A fitting as claimed in claim 1, wherein said guide member of said support rail is mounted on a side thereof opposite said running web thereof.

* * * * *